US011469530B2

(12) United States Patent
Guo et al.

(10) Patent No.: US 11,469,530 B2
(45) Date of Patent: Oct. 11, 2022

(54) CONNECTOR WITH TERMINALS ELECTRICALLY CONNECTED TO CABLES

(71) Applicant: Dongguan Luxshare Technologies Co., Ltd, Dongguan (CN)

(72) Inventors: Rong-Zhe Guo, Dongguan (CN); Bin Huang, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 36 days.

(21) Appl. No.: 17/153,419

(22) Filed: Jan. 20, 2021

(65) Prior Publication Data

US 2021/0143569 A1 May 13, 2021

(30) Foreign Application Priority Data

Apr. 15, 2020 (CN) ..... 202010295700.3

(51) Int. Cl.
*H01R 12/00* (2006.01)
*H01R 12/75* (2011.01)
*H01R 13/512* (2006.01)

(52) U.S. Cl.
CPC ..... *H01R 12/75* (2013.01); *H01R 13/512* (2013.01)

(58) Field of Classification Search
CPC ..... H01R 12/75; H01R 13/512
USPC ..... 439/74
See application file for complete search history.

(56) References Cited

U.S. PATENT DOCUMENTS 7,273,390 B2 * 9/2007 Iida ..... H01R 12/712 439/494
7,377,804 B2 * 5/2008 Lin ..... H01R 12/62 439/499
7,470,155 B1 * 12/2008 Soubh ..... H01R 12/716 439/701
7,553,167 B2 * 6/2009 Zhang ..... H01R 9/2416 439/597
7,637,767 B2 * 12/2009 Davis ..... H01R 13/506 439/352
7,690,923 B2 * 4/2010 Horchler ..... H01R 13/6271 439/67
8,043,114 B2 * 10/2011 Kaneko ..... H01R 12/775 439/468

(Continued)

FOREIGN PATENT DOCUMENTS

CN 1311542 A 9/2001
CN 2561115 Y 7/2003

(Continued)

*Primary Examiner* — Abdullah A Riyami
*Assistant Examiner* — Vladimir Imas
(74) *Attorney, Agent, or Firm* — Birch, Stewart, Kolasch & Birch, LLP

(57) ABSTRACT

A connector includes a substrate, a plurality of cables connected to a side of the substrate, and a plurality of terminals disposed on a surface of the substrate and electrically connected to the cables. Each of the terminals includes a connecting portion, a bending portion and an extending portion. The connecting portions are electrically connected to the corresponding cables. Each of the bending portions extends from the corresponding connecting portion and includes a turning segment. The extending portion is formed by extending from the corresponding bending portion toward a direction away from the surface of the substrate.

13 Claims, 6 Drawing Sheets

(56) References Cited

U.S. PATENT DOCUMENTS

| | | | | |
|---|---|---|---|---|
| 8,388,370 | B2 * | 3/2013 | Yamaji | H01R 13/62994 439/497 |
| 8,602,812 | B2 * | 12/2013 | Ohsaka | H01R 13/6581 439/497 |
| 9,112,302 | B2 * | 8/2015 | Liao | H01R 12/777 |
| 9,281,597 | B2 * | 3/2016 | Hashiguchi | H01R 12/774 |
| 9,306,325 | B2 * | 4/2016 | Cheng | H01R 13/6271 |
| 9,748,677 | B2 * | 8/2017 | Urano | H01R 12/91 |
| 9,917,401 | B2 * | 3/2018 | Nagase | H01R 12/75 |
| 10,741,973 | B2 * | 8/2020 | Yufu | H01R 12/79 |
| 10,985,479 | B2 * | 4/2021 | Buck | H01R 12/85 |
| 11,128,092 | B2 * | 9/2021 | Yang | H01R 13/6273 |
| 11,211,744 | B2 * | 12/2021 | Zhu | H01R 12/7005 |
| 2004/0018766 | A1 * | 1/2004 | Wu | H01R 12/7058 439/327 |
| 2011/0151708 | A1 * | 6/2011 | Kaneko | H01R 12/714 439/660 |
| 2013/0040482 | A1 * | 2/2013 | Ngo | H01R 12/7023 439/328 |
| 2013/0090018 | A1 * | 4/2013 | Chiang | H01R 13/6271 439/660 |
| 2019/0267732 | A1 | 8/2019 | Buck et al. | |
| 2021/0006012 | A1 * | 1/2021 | Kajiura | H01R 13/6273 |

FOREIGN PATENT DOCUMENTS

| | | | |
|---|---|---|---|
| CN | 101044656 | A | 9/2007 |
| CN | 101593884 | A | 12/2009 |
| CN | 108155497 | A | 6/2018 |
| CN | 208478651 | U | 2/2019 |
| CN | 110401052 | A | 11/2019 |
| TW | M519849 | U | 4/2018 |
| TW | M578029 | U | 5/2019 |

* cited by examiner

CONNECTOR WITH TERMINALS ELECTRICALLY CONNECTED TO CABLES

CROSS-REFERENCE TO RELATED APPLICATION

This non-provisional application claims priority under 35 U.S.C. § 119(a) to Patent Application No. 202010295700.3 filed in China, P.R.C. on Apr. 15, 2020, the entire contents of which are hereby incorporated by reference.

BACKGROUND

Technical Field

The present invention provides a connector, and in particular, to a connector of which terminals are electrically connected to cables.

Related Art

Currently, connectors are widely used in various electronic devices. However, in structures of most connectors, for convenience and fast assembly, terminals and cables are directly connected to each other and assembled into a connector. Due to design problems of the structure, the direct connection between terminals and cables causes poor assembly quality.

SUMMARY

According to some embodiments, the present invention provides a connector including a substrate, a plurality of cables connected to a side of the substrate, and a plurality of terminals. The terminals are disposed on the surface of the substrate and electrically connected to the cables. Each of the terminals includes a connecting portion, a bending portion and an extending portion. Each of the connecting portions is electrically connected to the corresponding cable through the substrate. Each of the bending portions extends from the corresponding connecting portion and includes a turning segment. The extending portion extends from the corresponding bending portion toward a direction away from the surface of the substrate.

According to some embodiments, the extending portion further includes a contacting end facing toward a direction opposite to the substrate.

According to some embodiments, the substrate further includes a plurality of conductive pads, the terminals are connected to the conductive pads, and the conductive pads electrically connect the cables to the terminals.

According to some embodiments, the connector further includes a terminal base connected to the substrate, the terminal base includes a plurality of holes, each of the holes correspondingly accommodates one terminal, and the extending portions are exposed after passing through the terminal base.

The present invention further provides a connector mounted on an external substrate. The connector includes a housing, a substrate disposed on the housing, a plurality of cables connected to a side of the substrate, and a plurality of terminals. The terminals are disposed on the surface of the substrate and electrically connected to the cables. The extending portion of each terminal extends toward a direction away from the surface of the substrate.

According to some embodiments, the housing further includes a lower housing configured to contain the terminals, and an upper housing connected to the lower housing to cover the connector.

According to some embodiments, the connector further includes a terminal base connected to the lower housing, and the extending portion passes through the terminal base to abut against the external substrate.

According to some embodiments, the lower housing further includes a terminal notch, and the terminal passes through the through the terminal notch to abut against the external substrate.

According to some embodiments, the terminal base further includes a plurality of holes, and each of the holes correspondingly accommodates one terminal.

According to some embodiments, the lower housing further includes a side wall, and when the upper housing is connected to the lower housing, an upper surface of upper housing forms the same plane with a top surface of the side wall.

According to some embodiments, each terminal further includes a connecting portion and a bending portion. The connecting portion abuts against the substrate and is electrically connected to the corresponding cable. The bending portion extends from the connecting portion and includes a turning segment, the extending portion extends from the bending portion toward the direction away from the surface of the substrate, and the connecting portion is connected to the surface of the substrate.

According to some embodiments, after extending from the bending portion toward the direction away from the surface of the substrate, the extending portion bends toward the surface of the substrate.

According to some embodiments, a side of the substrate connected with the cables is ladder-shaped.

Detailed features and advantages of the present invention are described in the following embodiments, which are enough to allow any person skilled in the art to understand and implement the technical content of the present invention, and any person skilled in the art can easily understand the purpose and advantages of the present invention according to the content disclosed in the specification, the scope of patent application and the drawings.

DETAILED DESCRIPTION

Figure 1:
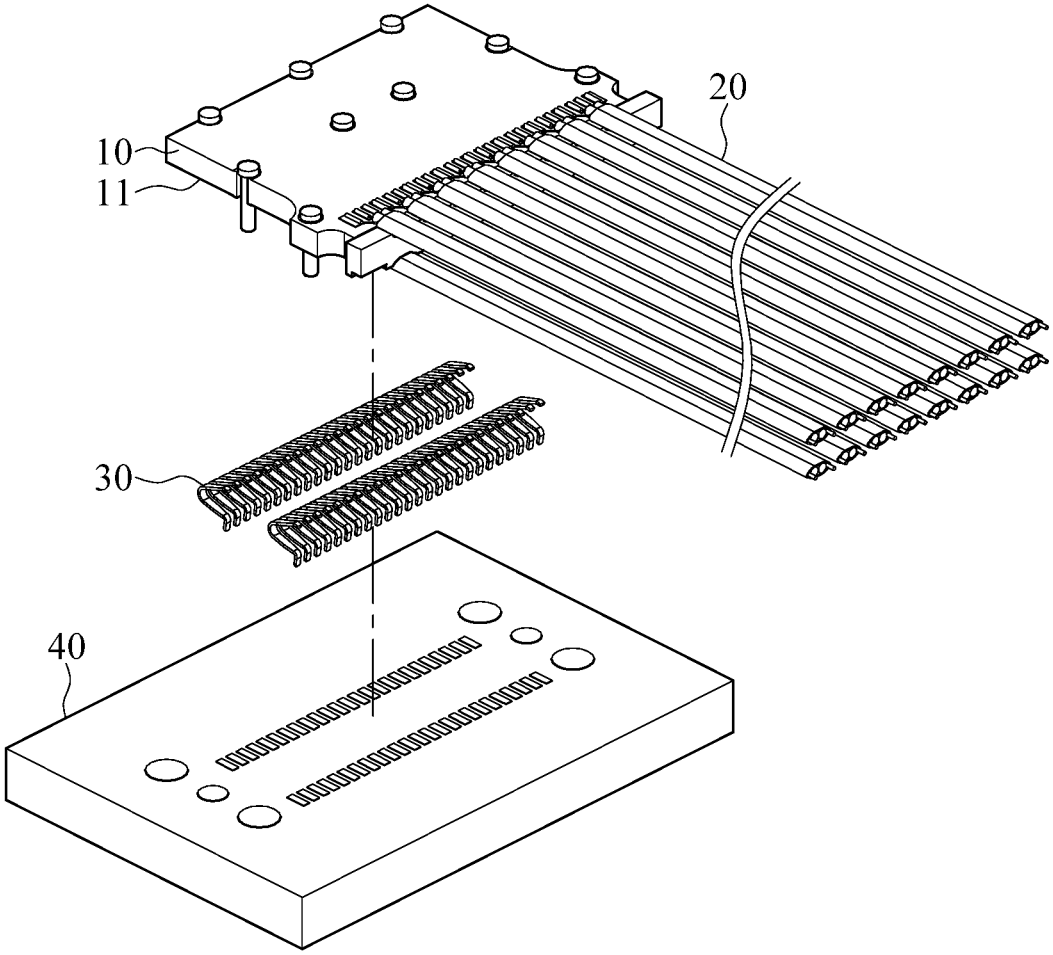
FIG. 1 is a schematic assembly diagram of a connector, terminals and an external substrate according to some embodiments.
Figure 2:
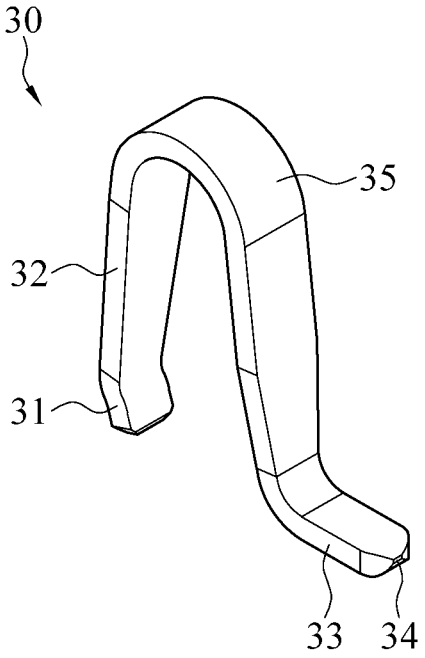
FIG. 2 is a three-dimensional schematic diagram of a terminal according to some embodiments.

Referring to FIG. 1 and FIG. 2, FIG. 1 is a schematic assembly diagram of a connector, terminals and an external substrate according to some embodiments. FIG. 2 is a three-dimensional schematic diagram of a terminal according to some embodiments. A connector includes a substrate 10, a plurality of cables 20, and a plurality of terminals 30.

The substrate 10 is preferably a circuit board. The plurality of cables 20 are connected to a side of the substrate 10. Specifically, the cables 20 are connected to a surface of the substrate 10 near the side. Taking the perspective of FIG. 2 as an example, the cables 20 are connected to an upper surface and a lower surface of the substrate 10 near the right side. In some embodiments, the cables 20 are soldering on the substrate 10 and form an electrical connection with the substrate 10. Taking the foregoing substrate 10 being a circuit board as an example, a surface of the circuit board is provided with a printed circuit, and the cables 20 are respectively electrically connected to the corresponding printed circuits on the circuit board. In some embodiments, the cables 20 may be arranged in one row in sequence. In some embodiments, the cables 20 are arranged in two rows up and down and connected to the corresponding two surfaces on the same side of the substrate 10. Taking FIG. 1 as an example, the two rows of the cables 20 are respectively connected to the upper and lower surfaces on the right side of the substrate 10.

The terminals 30 are preferably made of an elastic structure and are disposed on one of the surfaces of the substrate 10. Taking FIG. 1 as an example, the terminals 30 are connected to the lower surface of the substrate 10. In some embodiments, the terminals 30 are soldering on the substrate 10 to form an electrical connection with the substrate 10. In some embodiments, the terminals 30 are disposed on a surface of the substrate 10 and are electrically connected to the cables 20. In some embodiments, another surface of the substrate 10 is provided with a plurality of terminals 30 such that both surfaces of the substrate 10 are provided with a plurality of terminals 30. In some embodiments, the terminals 30 are arranged in one row in sequence, or the terminals 30 are arranged in two rows, and each row of terminals 30 is electrically connected to the corresponding row of cables 20.

Additionally, the substrate 10 further includes a plurality of conductive pads 11. When each terminal 30 is disposed on the surface of the substrate 10, the cable 20 is electrically connected to the terminal 30 individually through the conductive pad 11. The terminal 30 is directly connected to the conductive pad 11, and is electrically connected to the cable 20 through the conductive pad 11.

Referring to FIG. 2 again, FIG. 2 is a three-dimensional schematic diagram of a terminal according to some embodiments. Each of the terminals 30 of the present invention includes a connecting portion 31, a bending portion 32, and an extending portion 33. The connecting portion 31 is electrically connected to the corresponding cable 20 through the substrate 10. The connecting portion 31 is provided with a warpage at an end in contact with the substrate 10. Further, the warpage of the connecting portion 31 is in contact with the substrate 10. In some embodiments, the connecting portion 31 is not provided with the warpage.

The bending portion 32 extends from the connecting portion 31 and bends to have a turning segment 35. The bending portion 32 is generally in a V-shaped structure in an overall view. The extending portion 33 extends from an end of the bending portion 32 toward a direction away from the connecting portion 31. Taking FIG. 2 as an example, the extending portion 33 extends from an end of the bending portion 32 toward a direction away from the substrate 10. The turning segment 35 forms an angle of about 20° to 60°. A tail end of the extending portion 33 further includes a contacting end 34, and the contacting end 34 faces toward a direction away from the substrate 10 and the connecting portion 31. There is an angle between the extending portion 33 and the bending portion 32, and the angle is about 70° to 130°.

Figure 3:
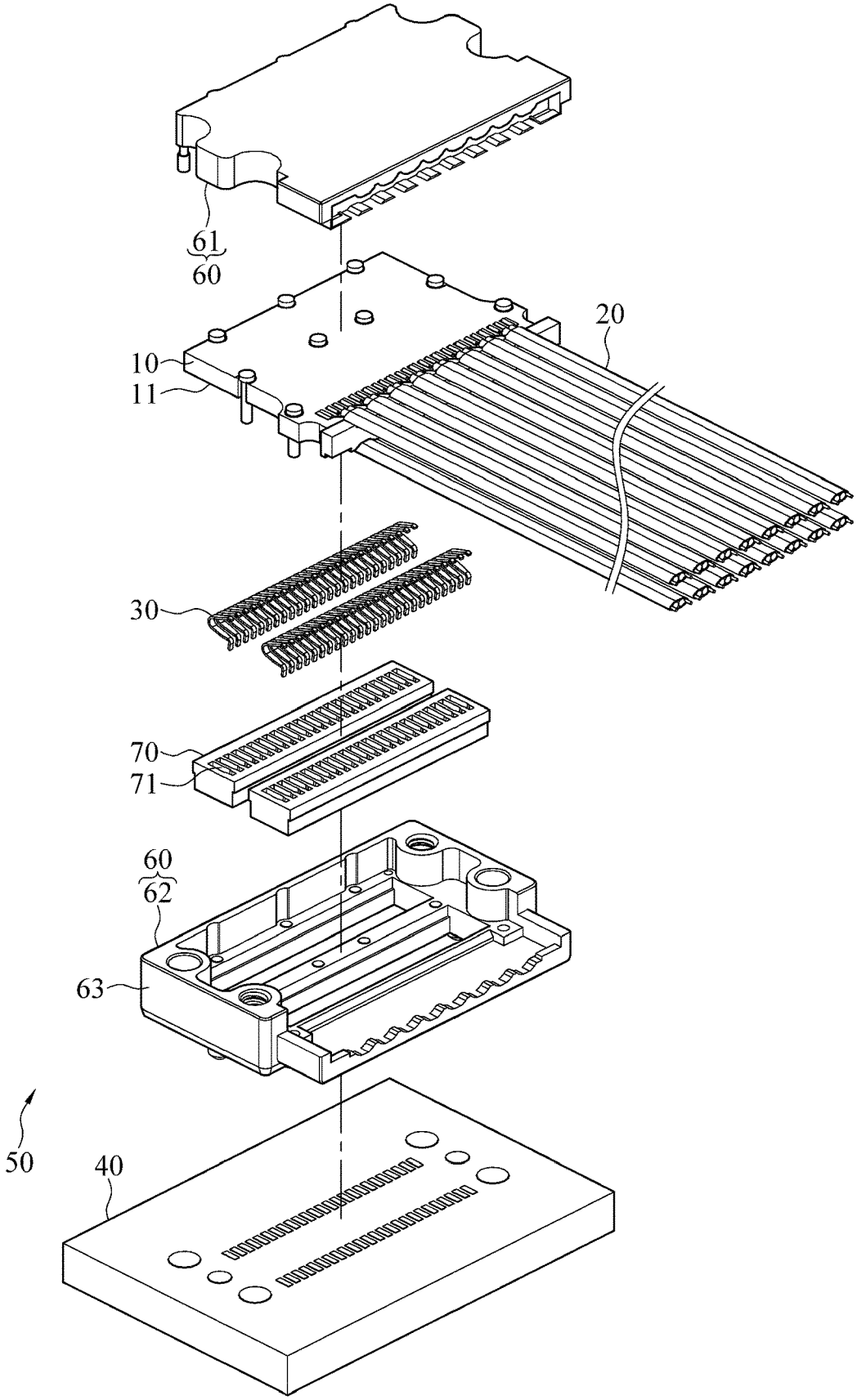
FIG. 3 is a three-dimensional exploded schematic diagram of a connector according to some embodiments.
Figure 4A:
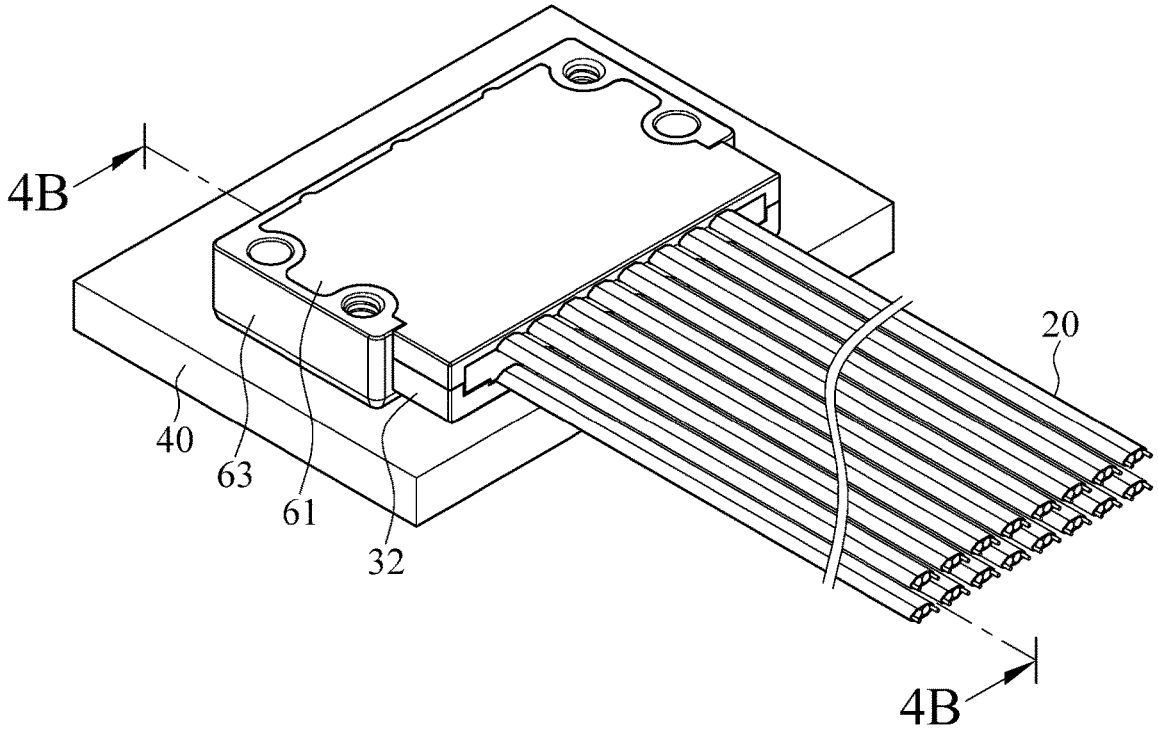
FIG. 4A is a three-dimensional schematic diagram of a connector according to some embodiments of the present invention.
Figure 4B:
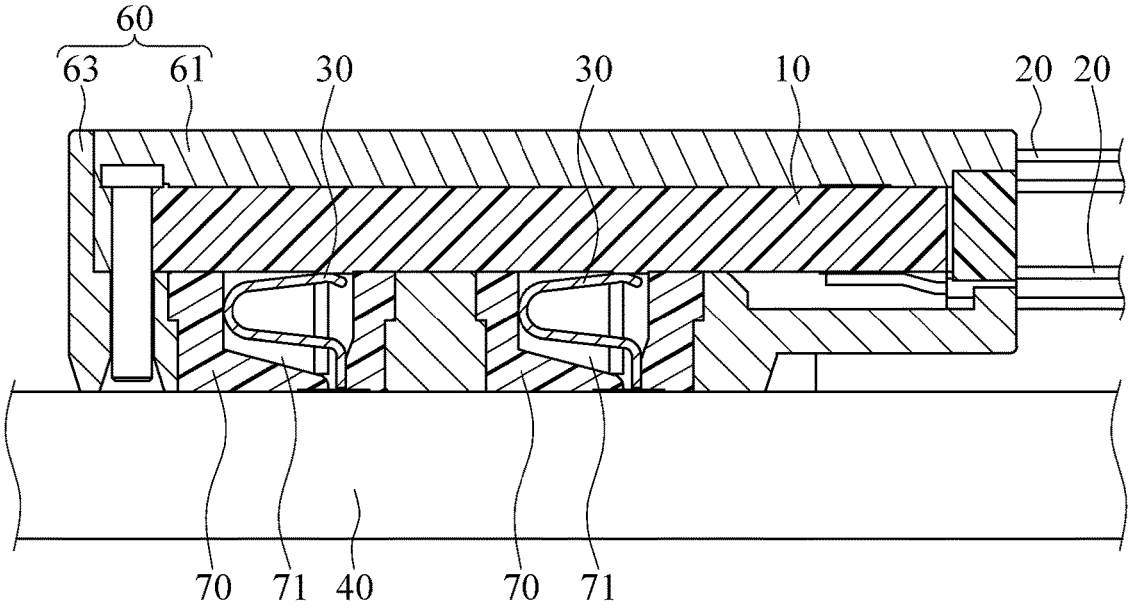
FIG. 4B is a sectional view of the connector in FIG. 4A taken along 4B-4B.

Referring to FIG. 3, FIG. 4A, and FIG. 4B, FIG. 3 is a three-dimensional exploded schematic diagram of a connector according to some embodiments. FIG. 4A is a three-dimensional schematic diagram of a connector according to some embodiments of the present invention. FIG. 4B is a sectional view of the connector in FIG. 4A taken along 4B-4B. The connector is mounted on an external substrate 40 and includes a housing 60, a substrate 10, a plurality of cables 20, and a plurality of terminals 30.

The external substrate 40 is preferably a circuit board. A connector 50 is mounted on a surface of the external substrate 40. Based on this, the connector 50 includes a housing 60, a substrate 10, a plurality of cables 20, and a plurality of terminals 30. The substrate 10 is disposed in the housing 60, and the connecting portion 31 of each terminal 30 is connected to a surface of the substrate 10. In some embodiments, the terminals 30 are soldering on the substrate 10 to form an electrical connection with the substrate 10. The extending portion 33 passes through the housing 60 to abut against the external substrate 40. In some embodiments, a surface of the external substrate 40 is provided with a printed circuit, and each extending portion 33 is respectively electrically connected to the corresponding printed circuit on the external substrate 40.

Figure 5:
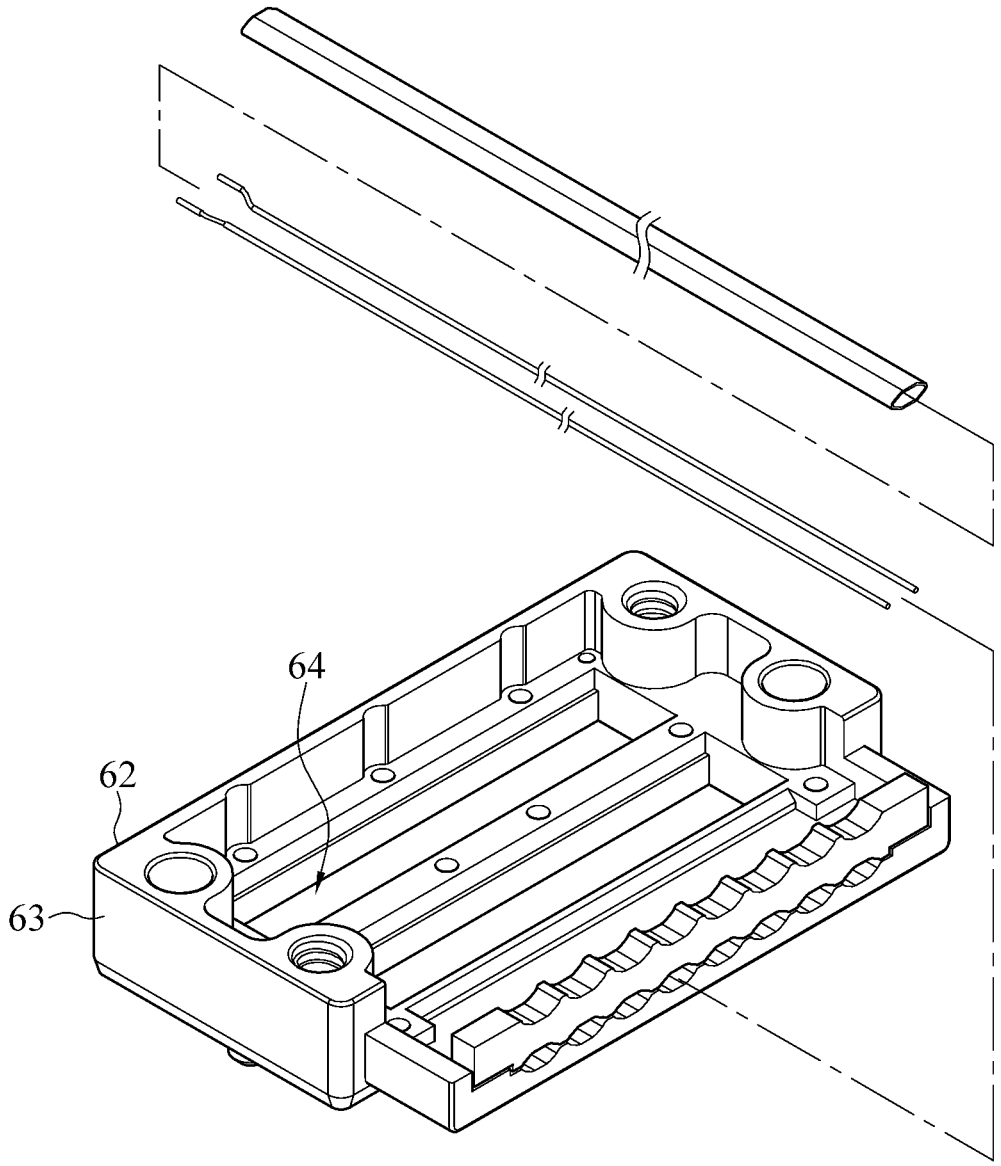
FIG. 5 is a schematic diagram of a lower housing according to some embodiments.

Referring to FIG. 5, FIG. 5 is a schematic diagram of a lower housing according to some embodiments. The housing 60 includes an upper housing 61 and a lower housing 62. The lower housing 62, made of metal, has an accommodating space configured to contain the terminals 30. The lower housing 62 is not in contact with the terminals 30 and the cables 20. In some embodiments, the lower housing 62 may be preferably provided with a pluggable component, to be mounted on the external substrate 40 in a pluggable manner.

In some embodiments, the upper housing 61 may be connected to the lower housing 62 through an assembly, such as a screw or a pluggable component, in a pluggable manner, to cover the substrate 10 and the terminals 30 in the housing 60. In some embodiments, some segments of the cables 20 connected to a surface of the substrate 10 near the side are located in the housing 60, and other segments are exposed outside the housing 60.

Additionally, because the terminals 30 need to abut against the external substrate 40, the lower housing 62 further includes a terminal notch 64 to allow the terminals 30 to penetrate the lower housing 62 through the terminal notch 64 to directly abut against the external substrate 40. In some embodiments, the terminals 30 are arranged in one row in sequence, or the terminals 30 are arranged in two rows. Therefore, one or two rows of terminal notches 64 may be provided correspondingly.

In some embodiments, the connector 50 further includes a terminal base 70. The terminal base 70 also includes a plurality of holes 71, and each of the holes 71 correspondingly accommodates one terminal 30. The terminal base 70 is connected to the lower housing 62, and each of the terminals 30 abuts against the external substrate 40 correspondingly through each hole 71 of the terminal base 70. Further, the size and structure design of the terminal notch 64 allow the terminal notch 64 to exactly contain and clamp the terminal base 70, so that the plurality of terminals 30 penetrate the terminal base 70 and the lower housing 62 to abut against the external substrate 40. Further, the extending portion 33 is exposed after passing through the terminal base 70. In some embodiments, taking FIG. 4B as an example, the right and left portions of the structure of the hole 71 of the terminal base 70 are vertical wall surfaces, a bottom surface is connected to the left portion such that the bottom surface and the vertical wall surface of the left portion are generally L-shaped in a sectional view. The right portion of the structure of the hole 71 is not connected to the bottom surface, and forms a through-hole. Therefore, each of the terminals 30 can correspondingly penetrate one hole 71, and the space formed by the connection of the bottom surface and the left portion can accommodate the bending portion 32. The extending portion 33 penetrates the through-hole formed by the right part not connected to the bottom surface, to abut against the external substrate 40.

In some embodiments, the terminals 30 may not be soldering on the substrate 10, but is directly accommodated in the corresponding hole 71 of the terminal base 70. When the substrate 10 is connected to the lower housing 62 through an assembly, such as a screw or a pluggable component, in a pluggable manner, the substrate 10 is pressed toward the external substrate 40, to compress the terminals 30, so that the connecting portion 31 of each terminal 30 is in contact with the surface of the substrate 10, to form an electrical connection with the substrate 10. At the same time, the terminals 30 are compressed so that the extending portion 33 of each terminal 30 abuts against the external substrate 40 more tightly, and is respectively electrically connected to the corresponding printed circuit on the external substrate 40.

In some embodiments, when the upper housing 61 is connected to the lower housing 62, the terminal base 70 is covered in the housing 60. In addition, in some embodiments, the upper housing 61 and the terminal base 70 are preferably made of insulation materials, and the lower housing 62 is preferably made of a metal material.

Referring to FIG. 4A and FIG. 5 again, in some embodiments, the lower housing 62 further includes a side wall 63. When the upper housing 61 is connected to the lower housing 62, the upper housing 61 is disposed within the side wall 63 of the lower housing 62. Further, a structure of the upper housing 61 is smaller than that of the lower housing 62. When the upper housing 61 is connected to the lower housing 62, an upper surface of the upper housing 61 forms the same plane with a top surface of the side wall 63.

Figure 6A:
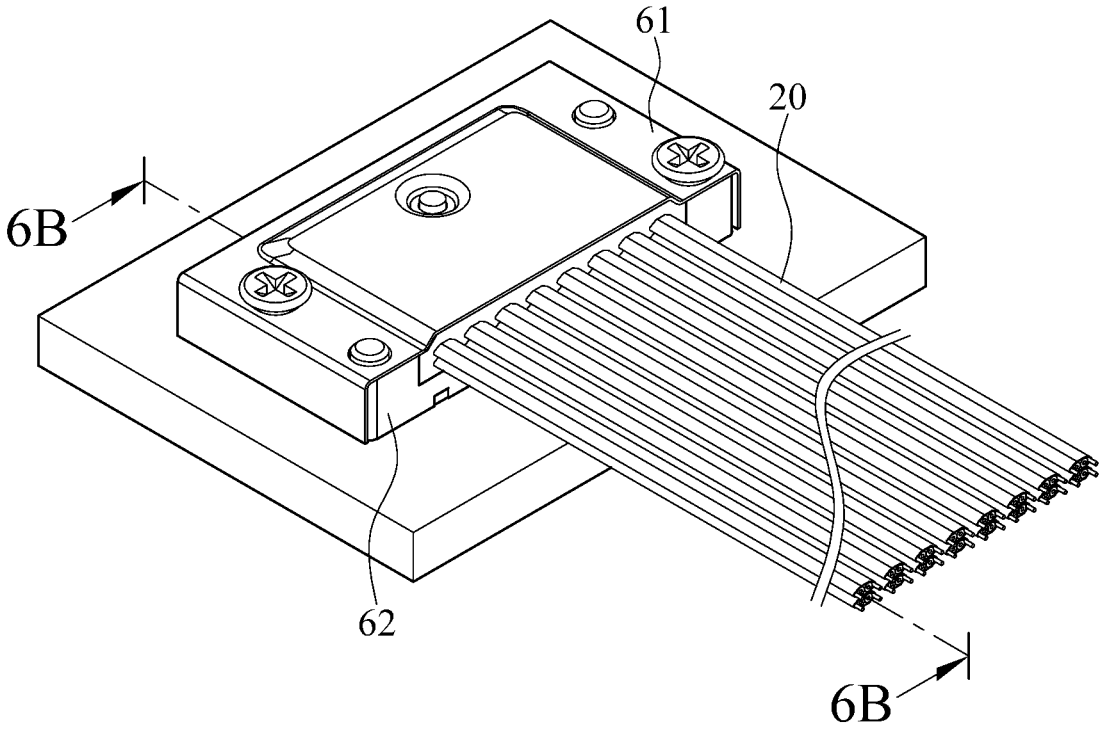
FIG. 6A is a three-dimensional schematic diagram of another embodiment of a connector according to some embodiments of the present invention.
Figure 6B:
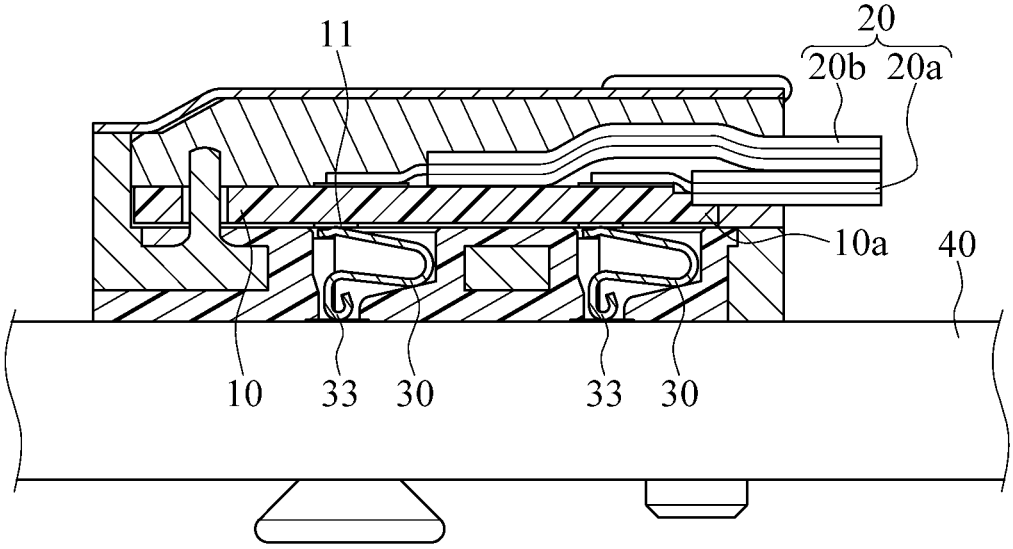
FIG. 6B is a sectional view of another embodiment of the connector in FIG. 6A taken along 6B-6B.

Refer to FIG. 6A and FIG. 6B. FIG. 6A is three-dimensional schematic diagram of another embodiment of a connector according to some embodiments of the present invention. FIG. 6B is a sectional view of another embodiment of the connector in FIG. 6A taken along 6B-6B.

In some embodiments, the upper housing 61 may be connected to the lower housing 62 through an assembly, such as a screw or a pluggable component, in a pluggable manner, to cover the substrate 10 and the terminals 30 in the housing 60. In this embodiment, the upper housing 61 is a wrapping structure that covers the lower housing 62, so that the terminal base 70 is covered in the housing 60. Referring to FIG. 6A, the upper housing 61 covers both the left and right side edges of the lower housing 62 in the upper housing 61. In some embodiments, the upper housing 61 is made of metal, and an insulation layer is disposed between the upper housing 61 and the substrate 10. The upper housing 61 is not in contact with the terminals 30 and the cables 20.

Referring to FIG. 6B, in this embodiment, a plurality of cables 20 are connected to a side of the substrate 10. Specifically, the cables 20 are divided into two rows, cables 20*a* in one row are connected to a surface of the substrate 10 near the side. Taking the perspective of FIG. 6B as an example, the cables 20*a* are connected to an upper surface of the substrate 10 near the right side. Cables 20*b* in another row are connected to the upper surface of the substrate 10 and are located above the cables 20*a*. In some embodiments, the terminals 30 are arranged in two rows, and each row of terminals 30 are respectively electrically connected to the corresponding cable 20*a* and cable 20*b*. In some embodiments, a side 10*a* of the substrate 10 connected to the cables 20 is ladder-shaped such that when the cables 20*a* are connected to the side 10*a* of the substrate 10, the cables 20*a* are partially contained in the space formed by the ladder shape.

In some embodiments, the extending portions 33 of the terminals 30 extend from the bending portions 32 toward a direction away from the lower surface of the substrate 10, and then bend to extend toward the lower surface of the substrate 10, so that the extending portions 33 each form an inverted hook shape.

In the connector, the terminals are electrically connected to the cables instead of being directly connected to the cables, thereby resolving the conventional assembly problem of poor assembly quality caused by the direct connection between the terminals and the cables during assembly.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector, comprising:

a substrate;

a plurality of cables, connected to a side of the substrate, wherein the plurality of cables are connected to a surface of the substrate near a side and form an electrical connection with the substrate; and a plurality of terminals, disposed on a surface of the substrate and electrically connected to the cables, wherein each of the terminals comprises:

a connecting portion, electrically connected to the corresponding cable;

a bending portion, extending from the connecting portion and comprising a turning segment; and an extending portion, extending from the bending portion toward a direction away from the surface of the substrate.

2. The connector according to claim 1, wherein the extending portion further comprises a contacting end, and the contacting end faces toward a direction opposite to the substrate.

3. The connector according to claim 1, wherein the substrate further comprises a plurality of conductive pads, and the conductive pads electrically connect the cables to the terminals.

4. The connector according to claim 1, further comprising a terminal base connected to the substrate, wherein the terminal base comprises a plurality of holes, each of the holes correspondingly accommodates one of the terminals, and the extending portions is exposed after passing through the terminal base.

5. A connector, mounted on an external substrate, the connector comprising:

a housing;

a substrate, disposed on the housing;

a plurality of cables, connected to a side of the substrate, wherein the plurality of cables are connected to a surface of the substrate near a side and form an electrical connection with the substrate; and a plurality of terminals, disposed on a surface of the substrate and electrically connected to the cable, wherein each of the terminals comprises:

an extending portion, extending toward a direction away from the surface of the substrate, an end of each of the terminals being connected to the surface of the substrate, and the extending portion passing through the housing to abut against the external substrate.

6. The connector according to claim 5, wherein the housing further comprises:

a lower housing, configured to contain the terminals; and an upper housing, connected to the lower housing to cover the substrate and at least part of the cables.

7. The connector according to claim 6, further comprising a terminal base connected to the lower housing, wherein the extending portion passes through the terminal base to abut against the external substrate.

8. The connector according to claim 7, wherein the terminal base further comprises a plurality of holes, each of the holes correspondingly accommodating one of the terminals.

9. The connector according to claim 6, wherein the lower housing further comprises a terminal notch, and the terminals pass through the terminal notch to abut against the external substrate.

10. The connector according to claim 6, wherein the lower housing further comprises a side wall, and when the upper housing is connected to the lower housing, an upper surface of the upper housing forms the same plane with a top surface of the side wall.

11. The connector according to claim 5, wherein each of the terminals further comprises:

a connecting portion, connected to the substrate and electrically connected to the corresponding cable; and a bending portion, extending from the connecting portion and comprising a turning segment, the extending portion extending from the bending portion toward a direction away from the surface of the substrate, and the connecting portion being connected to the surface of the substrate.

12. The connector according to claim 11, wherein after extending from the bending portion toward the direction away from the surface of the substrate, the extending portion bends to extend toward the surface of the substrate.

13. The connector according to claim 5, wherein a side of the substrate connected with the cables is ladder-shaped.

* * * * *